US005605253A

United States Patent [19]

Luk

[11] Patent Number: 5,605,253

[45] Date of Patent: Feb. 25, 1997

[54] WATER-EJECTION TOY

[75] Inventor: Ka-Shiu Luk, Hong Kong, Hong Kong

[73] Assignee: Heep Tung Manufactory Limited, Hong Kong

[21] Appl. No.: 432,944

[22] Filed: May 1, 1995

[51] Int. Cl.[6] ..... A63H 3/18

[52] U.S. Cl. ..... 222/79; 222/382; 222/520; 239/458

[58] Field of Search ..... 222/79, 341, 381, 222/382, 464.1, 520; 239/457–458; 446/405, 473

[56] References Cited

U.S. PATENT DOCUMENTS

| | | | |
|---|---|---|---|
| 2,746,644 | 5/1956 | Steiner | 222/79 |
| 3,091,370 | 5/1963 | Weiner | 222/79 |
| 3,363,842 | 1/1968 | Burns | 239/458 X |
| 3,893,624 | 7/1975 | Thompson | 239/458 X |
| 5,333,792 | 8/1994 | Wang | 239/457 X |

FOREIGN PATENT DOCUMENTS

| | | | |
|---|---|---|---|
| 998699 | 1/1952 | France | 222/79 |
| 1045847 | 10/1966 | United Kingdom | 222/79 |

*Primary Examiner*—Joseph Kaufman
*Attorney, Agent, or Firm*—Samuels, Gauthier, Stevens & Reppert

[57] ABSTRACT

A water-ejection toy comprising a body having a front end, a nozzle unit provided at the front end of the body, a reservoir provided inside the body for containing water, and a pump assembly supported by the body for delivering water from the reservoir to the nozzle unit for discharge through the nozzle unit. The nozzle unit has a housing including a tubular front end and an apertured cap fit co-axially over the tubular front end through screw-thread engagement. The nozzle unit is adapted to provide a dispersed discharge of water upon tightening of the cap and a concentrated discharge of water upon loosening of the cap.

12 Claims, 3 Drawing Sheets

WATER-EJECTION TOY

The present invention relates to a water-ejection toy, for example in the form of a toy pistol which is adjustable to provide different forms of water ejection.

SUMMARY OF THE INVENTION

According to a first aspect of the invention, there is provided a water-ejection toy which comprises a body having a front end, a nozzle unit provided at the front end of the body, a reservoir provided inside the body for containing water, and a pump assembly supported by the body for delivering water from the reservoir to the nozzle unit for discharge through the nozzle unit, which nozzle unit has a housing and an internal valve formed by a spring-loaded valve member and a valve seat against which the valve member is to engage to control the discharge of water, said housing including a front part which has an aperture through which water is to be discharged and is movable between an inner position to have the valve member bear resiliently against the valve seat to effect a dispersed discharge of water and an outer position to have the valve member disengaged from the valve seat to effect a concentrated discharge of water.

Preferably, the front part of the housing is connected to the rest of the housing through screw-thread engagement such that the front part is movable between its inner and outer positions upon turning.

More preferably, the front part of the housing is in the form of a cap.

In a specific construction, the nozzle unit includes an internal tubular member having open and closed ends to at least partially receive the valve member through the open end, and further includes a spring inside the tubular member to resiliently urge the tubular member and the valve member apart against the front part of the housing and the valve seat, respectively, only when the front part is in the inner position.

Preferably, the front part of the housing is provided with a sleeve to hold the tubular member in position.

In a preferred embodiment, the water-ejection toy is in the form of a water pistol.

According to a second aspect of the invention, there is provided a water-ejection toy which comprises a body having a front end, a nozzle unit provided at the front end of the body, a reservoir provided inside the body for containing water, and a pump assembly supported by the body for delivering water from the reservoir to the nozzle unit for discharge through the nozzle unit, which nozzle unit has a housing including a tubular front end and an apertured end-piece fit co-axially over the tubular front end through screw-thread engagement, and is adapted to provide a dispersed discharge of water upon tightening of the end-piece and a concentrated discharge of water upon loosening of the end-piece.

Preferably, the end-piece is in the form of a cap.

Preferably, the nozzle unit includes an internal valve formed by a spring-loaded valve member and a valve seat against which the valve member is to engage to control the discharge of water.

More preferably, the nozzle unit further includes an internal tubular member having open and closed ends to at least partially receive the valve member through the open end, and a spring inside the tubular member to resiliently urge the tubular member and the valve member apart against the end-piece and the valve seat, respectively, only when the end-piece is tightened.

It is further preferred that the end-piece is provided with a sleeve to hold the tubular member in position.

BRIEF DESCRIPTION OF DRAWINGS

The invention will now be more particulary described, by way of example only, with reference to the accompanying drawings, in which.

DETAILED DESCRIPTION OF PREFERRED EMBODIMENT

Figure 1:
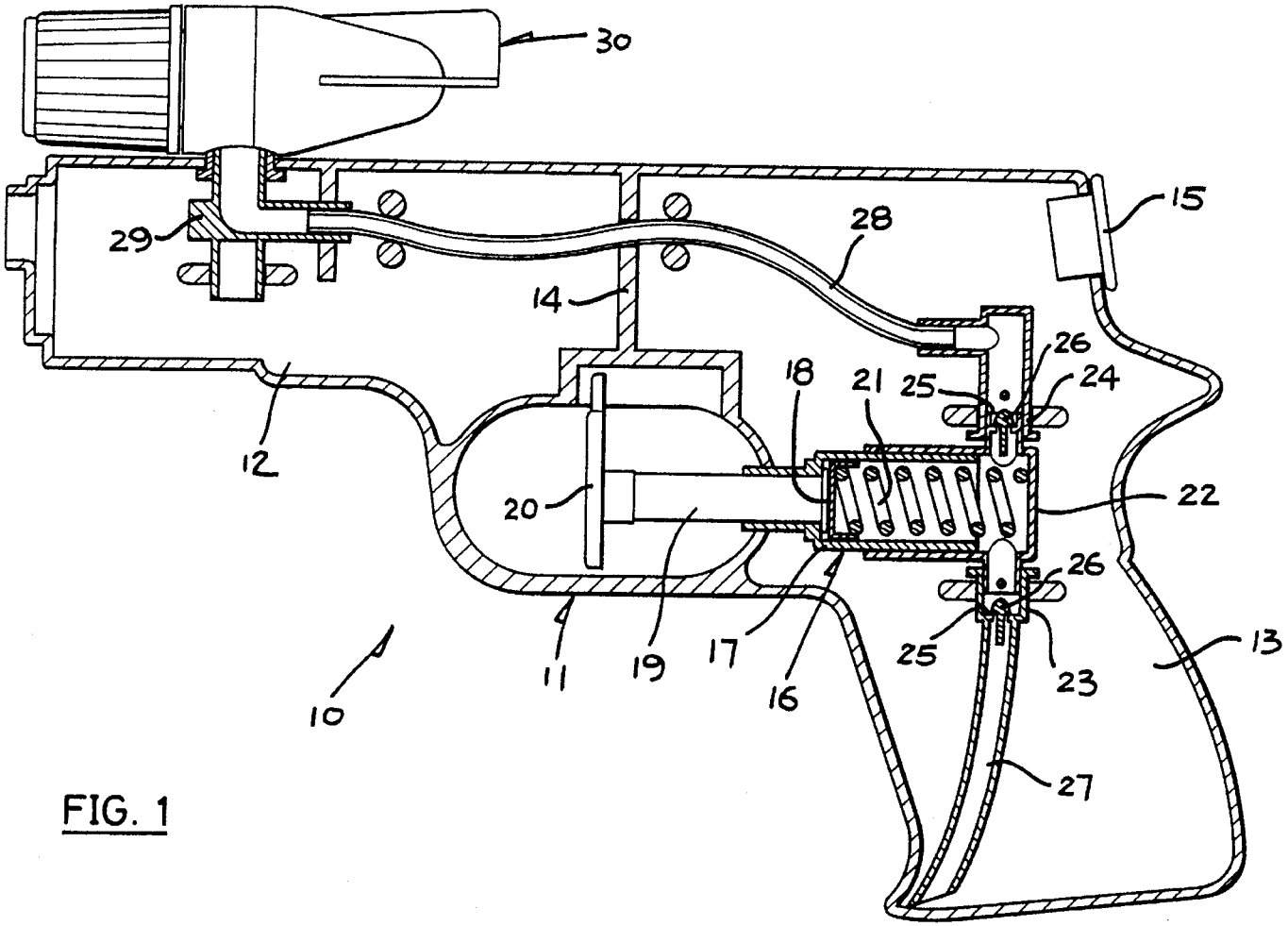
FIG. 1 is a cross-sectional side view of an embodiment of a water-ejection toy in accordance with the invention, showing a nozzle unit thereof.

Referring firstly to FIG. 1 of the drawings, there is shown a water-ejection toy, in the form of a water pistol 10, embodying the invention. The pistol 10 has a hollow S plastic body 11 which is in the shape of a barrel and a handgrip and is internally divided into front and rear compartments 12 and 13 by a partition 14. The rear compartment 13 is practically water-tight to serve as a reservoir for containing water, which reservoir 13 is refillable with water when a stopper 15 provided at the rear top corner is removed.

A manual water pump 16 is provided generally inside the reservoir 13, which is formed by a horizontally disposed cylinder 17, a cap-like piston 18 slidable co-axially inside the cylinder 17 and a co-axial operating shaft 19 engaged with the outer side of the piston 18. The free end of the shaft 19 takes the form of a trigger 20 of the pistol 10, which is resiliently biassed forwards under the action of a compression coil spring 21. The spring 21 is disposed horizontally inside the cylinder 17, co-acting between the piston 18 and a rear end wall 22 of the cylinder 17.

A pair of one-way valves 23 (lower) and 24 (upper) are fitted on opposite sides of the cylinder 17, adjacent the rear end wall 22. Each valve 23/24 has a valve seat 25 and a co-operating valve member 26 sitting on the seat 25 to permit the passage of water only in the upward direction. In this arrangement, the lower valve 23 acts as a water inlet and the upper valve 24 acts as a water outlet. The lower valve 23 has a tube 27 extending down to the bottom of the reservoir 13 (handgrip bottom). The upper valve 24 has a tube 28 extending forward through the partition 14 into the front compartment 12.

The water pistol 10 includes a nozzle unit 30, in the shape of a missile, which is mounted on the front end of the body 11. The front end of the tube 28 is connected to the nozzle unit 30 by means of an elbow joint 29 such that water may be driven by the pump 16 to travel from the reservoir 13 to the nozzle unit 30 for discharge therefrom.

Figure 2:
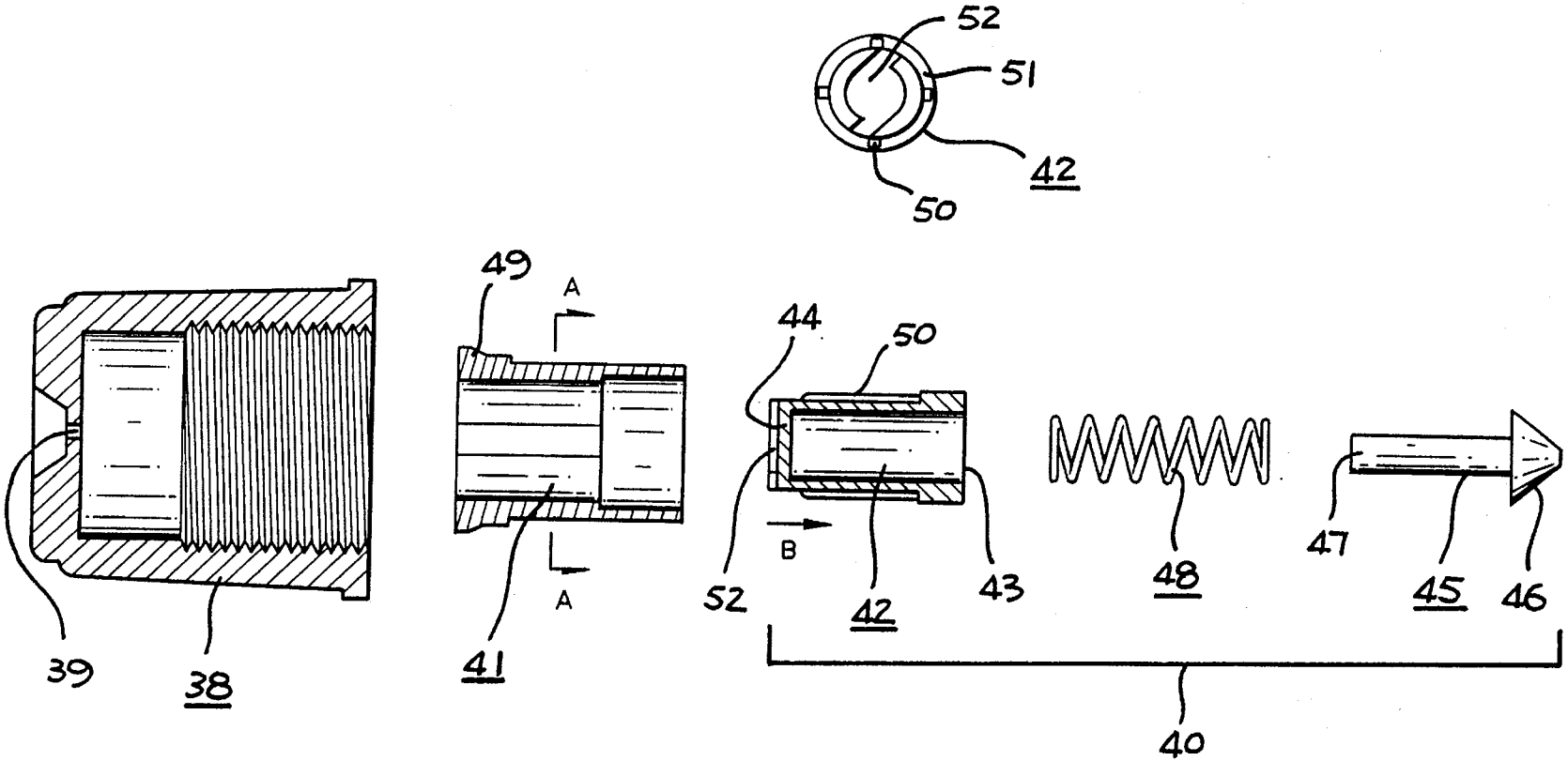
FIG. 2 is an exploded cross-sectional side view of the nozzle unit of FIG. 1.
Figure 3:
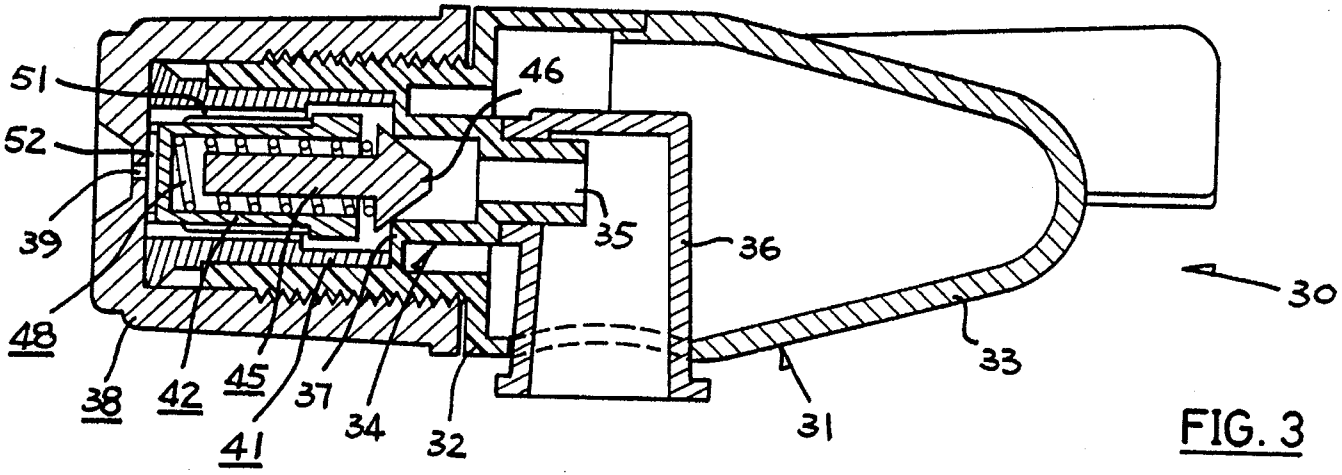
FIG. 3 is a cross-sectional side view of the nozzle unit of FIG. 1, in a first operating condition.
Figure 4:
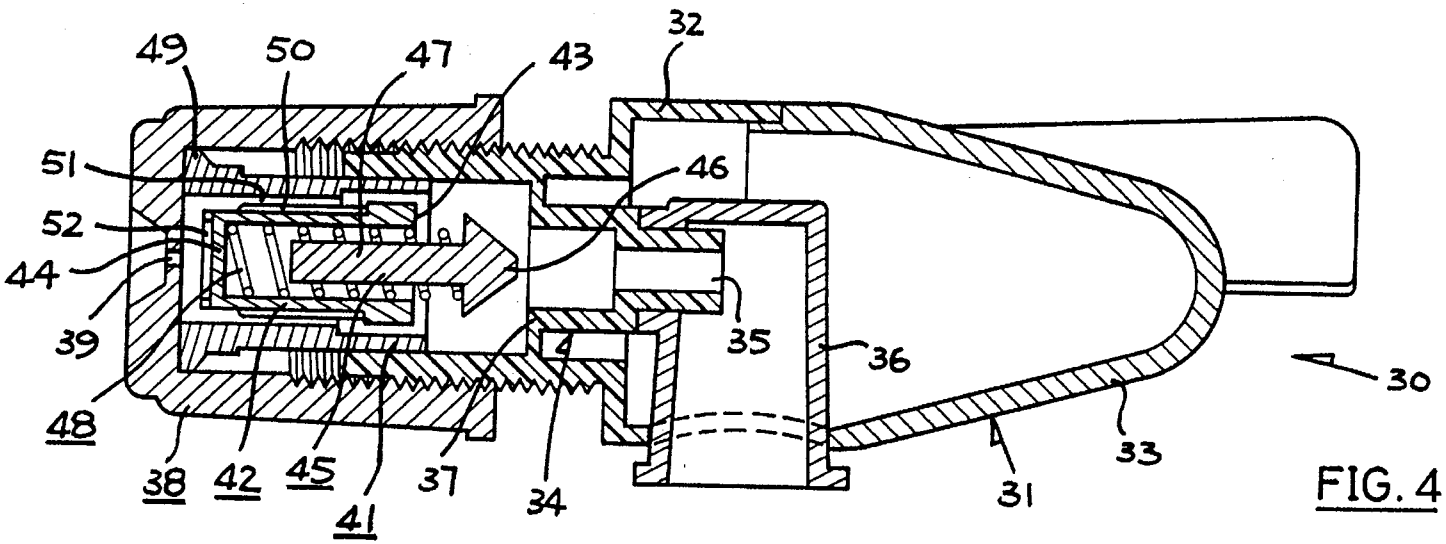
FIG. 4 is a cross-sectional side view of the nozzle unit of FIG. 1, in a second operating condition.

Referring now to FIGS. 2 to 4 of the drawings, the nozzle unit 30 has a housing 31 which is formed by front and rear housing parts 32 and 33 connected co-axially together. The front housing part 32 terminates rearwards centrally in an integral tubular core 34. Rear end 35 of the core 34 is reduced in diameter to fit horizontally into one side of a vertical tubular coupler 36 which extends downwards to couple with the elbow joint 29. Front end 37 of the core 34 provides a valve seat. Water coming up through the elbow joint 29 is arranged to travel through the coupler 36 and then the core 34 (valve seat 37) into the front housing part 32. The front end of the front housing part 32 is tubular and externally screw-threaded.

The nozzle unit 30 has a front end cap 38 which is fit over the front end of the front housing part 32 through screw-thread engagement. The end cap 38 has a central orifice 39 and is capable of being turned to be tightened (FIG. 3) or loosened (FIG. 4) on the front housing part 32. The nozzle unit 30 further includes a valve unit 40 and a sleeve holder 41 which holds the valve unit 40 co-axially inside the front housing part 32 at a position between the end cap 38 and the core 34.

The valve unit 40 is formed by a tubular member 42 which has an open rear end 43 and a closed front end 44, a valve member 45 which has a frusto-conical head 46 and a shaft 47, and a compression coil spring 48. The valve member 45 is inserted rearwards partially into the tubular member 42 through the tubular open end 43, with the spring 48 disposed on the shaft 47 and co-acting between the tubular closed end 44 and the valve member head 46.

The sleeve holder 41 has an enlarged front end 49, and is fit co-axially inside the end cap 38 with its enlarged end 49 jammed fully into the end cap 38, whereby the sleeve holder 41 is carried by the end cap 38. With the end cap 38 fit onto the front housing part 32, the sleeve holder 41 extends co-axially rearwards into the front end of the front housing part 32. The sleeve holder 41 co-axially receives and thereby holds the valve unit 40 in position, with the valve member 45 pointing rearwards to have its head 46 bear against the valve seat 37 on the core 34 under the action of the spring 48.

The tubular member 42 is slightly larger at its open end 43, and has four equi-angularly spaced external ribs 50 extending longitudinally from the slightly larger open end 43 towards the closed end 44. The inner side of the sleeve holder 41 is slightly larger at its rear end to loosely cater for the slightly larger open end 43 of the tubular member 42, and is generally slightly oversized compared with the tubular member 42 so as to form a longitudinally-extending annular gap 51 therebetween. The annular gap 51 is maintained open all around by the ribs 50 on the tubular member 42, A diametrically-extending gap 52 is formed on the outer side of the closed end 44 of the tubular member 42.

FIG. 3 shows the first operating condition of the nozzle unit 30, in which the end cap 38 is tightened on the housing 31 to be in an inner position. Under the action of the spring 48, the tubular member 42 and the valve member 45 are resiliently urged apart in opposite directions against the end cap 38 and the valve seat 37, respectively. Under this condition, the water driven up by the pump 16 will push the valve member 45 marginally off the valve seat 37, thereby opening the valve formed therebetween, and continue to travel round the tubular member 42 through the annular side gap 51 and the end gap 52 and is finally expelled through the orifice 39 of the end cap 38.

Under the action of the pump 16 and the spring 48, the valve formed by the valve member 45 and seat 37 will be momentarily opened and closed in quick successions by the water under a pressure which is repeatedly both built up and released. Accordingly, the water is forced through the valve and thus expelled from the pistol 10 in the form of a spray, that being a dispersed discharge of water.

FIG. 4 shows the second operating condition of the nozzle unit 30, in which the end cap 38 is loosened on the housing 31 to be in an outer position. The valve unit 40, now extending fully under the action of the spring 48, becomes free and does no longer have its valve member 45 bear against the valve seat 37. Under this condition, the water driven up by the pump 16 will travel straight through the valve formed by the valve member 45 and seat 37 and then round the tubular member 42 through the annular gap 51. Finally, the water is expelled from the pistol 10, through the orifice 39 of the end cap 38, in the form of a squirt, that being a concentrated discharge of water.

The invention has been given by way of example only, and various modifications of and/or alterations to the described embodiment may be made by persons skilled in the art without departing from the scope of the invention as specified in the appended claims.

What is claimed is:

1. A water-ejection toy comprising a body having a front end, a nozzle unit provided at the front end of the body, a reservoir provided inside the body for containing water, and a pump assembly supported by the body for delivering water from the reservoir to the nozzle unit for discharge through the nozzle unit, which nozzle unit has a housing and an internal valve comprising a spring-loaded valve member and a valve seat against which the valve member is to engage to control the discharge of water, said housing including a front part which has an aperture through which water is to be discharged and is movable between an inner position to have the valve member bear resiliently against the valve seat to effect a dispersed discharge of water and an outer position to have the valve member disengaged from the valve seat to effect a concentrated discharge of water.

2. A water-ejection toy as claimed in claim 1, wherein the front part of the housing and the rest of the housing have screw-threads and wherein the front part of the housing is connected to the rest of the housing through screw-thread engagement such that the front part is movable between its inner and outer positions upon turning.

3. A water-ejection toy as claimed in claim 2, wherein the front part of the housing is in the form of a cap.

4. A water-ejection toy as claimed in claim 1, wherein the nozzle unit includes an internal tubular member having open and closed ends to at least partially receive the valve member through the open end, and further includes a spring inside the tubular member to resiliently urge the tubular member and the valve member apart against the front part of the housing and the valve seat, respectively, only when the front part is in the inner position.

5. A water-ejection toy as claimed in claim 4, wherein the front part of the housing is provided with a sleeve to hold the tubular member in position.

6. A water-ejection toy as claimed in claim 4, wherein valve member is urged in a direction opposite the discharge aperture.

7. A water-ejection toy as claimed in claim 1, being in the form of a water pistol.

8. A water-ejection toy comprising a body having a front end, a nozzle unit provided at the front end of the body, a reservoir provided inside the body for containing water, and a pump assembly supported by the body for delivering water from the reservoir to the nozzle unit for discharge through the nozzle unit, which nozzle unit has a housing including a tubular front end and an apertured end-piece; the tubular front end and the apertured end-piece each have screw-threads; the apertured end-piece which fits co-axially over the tubular front end through screw-thread engagement, and is adapted to provide a dispersed discharge of water upon tightening of the end-piece and a concentrated discharge of water upon loosening of the end-piece.

9. A water-ejection toy as claimed in claim 8, wherein the end-piece is in the form of a cap.

10. A water-ejection toy as claimed in claim 8, wherein the nozzle unit includes an internal valve comprising a spring-loaded valve member and a valve seat against which the valve member is to engage to control the discharge of water.

11. A water-ejection toy as claimed in claim 10, wherein the nozzle unit further includes an internal tubular member having open and closed ends to at least partially receive the valve member through the open end, and a spring inside the tubular member to resiliently urge the tubular member and the valve member apart against the end-piece and the valve seat, respectively, only when the end-piece is tightened.

12. A water-ejection toy as claimed in claim 11, wherein the end-piece is provided with a sleeve to hold the tubular member in position.

* * * * *